US008128194B2

(12) United States Patent
Okada

(10) Patent No.: US 8,128,194 B2
(45) Date of Patent: Mar. 6, 2012

(54) INKJET RECORDING APPARATUS

(75) Inventor: Goro Okada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 310 days.

(21) Appl. No.: 12/182,317

(22) Filed: Jul. 30, 2008

(65) Prior Publication Data

US 2009/0033714 A1 Feb. 5, 2009

(30) Foreign Application Priority Data

Jul. 31, 2007 (JP) ..... 2007-199905

(51) Int. Cl.
*B41J 2/165* (2006.01)

(52) U.S. Cl. ..... 347/33; 347/29

(58) Field of Classification Search ..... 347/33, 347/29

See application file for complete search history.

(56) References Cited

U.S. PATENT DOCUMENTS

| | | | | |
|---|---|---|---|---|
| 7,140,716 | B2 * | 11/2006 | Jensen et al. | 347/33 |
| 7,229,149 | B2 | 6/2007 | Wotton et al. | |
| 7,360,878 | B2 * | 4/2008 | Takagi | 347/85 |
| 7,540,583 | B2 * | 6/2009 | Barinaga et al. | 347/28 |
| 2005/0024421 | A1 * | 2/2005 | Barinaga et al. | 347/22 |

FOREIGN PATENT DOCUMENTS

| | | | |
|---|---|---|---|
| JP | H10-175292 | A | 6/1998 |
| JP | 2005059597 | A | 3/2005 |
| JP | 2007-038558 | A | 2/2007 |

OTHER PUBLICATIONS

The State Intellectual Property Office of the People's Republic of China; Notification of First Office Action in Chinese Patent Application No. 200810129490.X (counterpart to the above-captioned U.S. patent application) mailed Dec. 25, 2009.

Japan Patent Office; Notice of Reasons for Rejection in Japanese Patent Application No. 2007-199905 (counterpart to the above-captioned U.S. patent application) mailed Oct. 4, 2011.

* cited by examiner

*Primary Examiner* — Julian Huffman
*Assistant Examiner* — Jason Uhlenhake
(74) *Attorney, Agent, or Firm* — Baker Botts L.L.P.

(57) ABSTRACT

An inkjet recording apparatus of the present invention includes: a drum which conveys a recording medium, a wiper extended in the axial direction of the drum, and inkjet heads aligned in the circumferential direction of the drum along the outer circumferential surface of the drum. The inkjet heads are moved by a head-moving mechanism to be in a recording position or a wiping position. The wiper-moving mechanism moves the wiper in the circumferential direction along the outer circumferential surface so that the wiper wipes ejection surface of at least one of the inkjet heads while the inkjet heads are in the wiping position.

9 Claims, 9 Drawing Sheets

INKJET RECORDING APPARATUS

CROSS REFERENCE TO RELATED APPLICATION

The present application claims priority from Japanese Patent Application No. 2007-199905, which was filed on Jul. 31, 2007, the disclosure of which is herein incorporated by reference in its entirety.

BACKGROUND OF THE INVENTION

1. Field of the Invention

The present invention relates to an inkjet recording apparatus which ejects ink droplets to record an image on a recording medium.

2. Description of the Related Art

Japanese Unexamined Patent Publication No. 59597/2005 (Tokukai 2005-59597) discloses an inkjet printer including a conveyance mechanism having a drum which rotates to convey a sheet carried on the outer circumferential surface thereof; a plurality of inkjet heads each having an ejection surface, which are aligned in a conveyance direction of the sheet so that the ejection surface of the each inkjet heads faces the outer circumferential surface of the drum; and a wiper for wiping the ejection surface. In this inkjet printer, all the inkjet heads are fixed on a frame structure. The frame structure is moveable between a printing position and a wiping position. The printing position is a position where the frame structure is disposed when ink droplets are ejected from an ejection surface to a sheet conveyed by the conveyance mechanism. The wiping position is such a position that the ejection surface is disposed farther apart from the outer circumferential surface of the drum, compared to the printing position. At a time of printing, the wiper is in a standby position and faces no ejection surfaces, and the frame structure is positioned in the printing position. At a time of a wiping operation, the frame structure moves to the wiping position. Then, the wiper moves in the circumferential direction of the drum, from the standby position to an opposing position so as to face the ejection surface. Then, the wiper reciprocates in the axial direction of the drum, thereby wiping the ejection surface.

SUMMARY OF THE INVENTION

In the above mentioned inkjet printer, however, the direction of the wiper moving from the standby position to the opposing position and the moving direction of the wiper at the time of wiping operation are different. This necessitates a complicated mechanism for operating the wiper.

In view of the above problem, the present invention is made, and it is an object of the present invention to provide an inkjet recording apparatus capable of wiping an ejection surface by means of a simple mechanism.

An inkjet recording apparatus of the present invention includes: a drum, a wiper, a plurality of inkjet heads, a head-moving mechanism, a wiper-moving mechanism, and a control unit. The drum has a cylindrical outer circumferential surface, and rotates about a rotation axis thereof to convey a recording medium retained on the outer circumferential surface. The wiper is extended in an axial direction of the drum. The inkjet heads are aligned in the circumferential direction of the drum along the outer circumferential surface of the drum. Further, each of the inkjet heads has an ejection surface on which a plurality of nozzles for ejecting ink droplets are opened, the ejection surface being extended in the axial direction and facing the outer circumferential surface. The head-moving mechanism moves the inkjet heads to any one of positions including a recording position and a wiping position. The recording position is a position where inkjet heads are disposed at a time of forming an image on a recording medium on the outer circumferential surface by ejecting ink droplets from the nozzles to the recording medium, and the wiping position is such a position that the ejection surface of each of the inkjet heads is farther distanced from the outer circumferential surface than in the recording position. The wiper-moving mechanism moves the wiper in the circumferential direction along the outer circumferential surface so as to wipe the ejection surface of at least one of the inkjet heads in the wiping position. The control unit which controls the wiper-moving mechanism so that the ejection surface of the at least one of the inkjet heads is wiped while the inkjet heads are in the wiping position.

According to the present invention, the wiper wipes the ejection surface of at least one of the inkjet heads when moving in the circumferential direction along the outer circumferential surface of the drum. Thus, it is possible to wipe the ejection surface by means of a simple structure in which the wiper is not moved in the axial direction of the drum.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
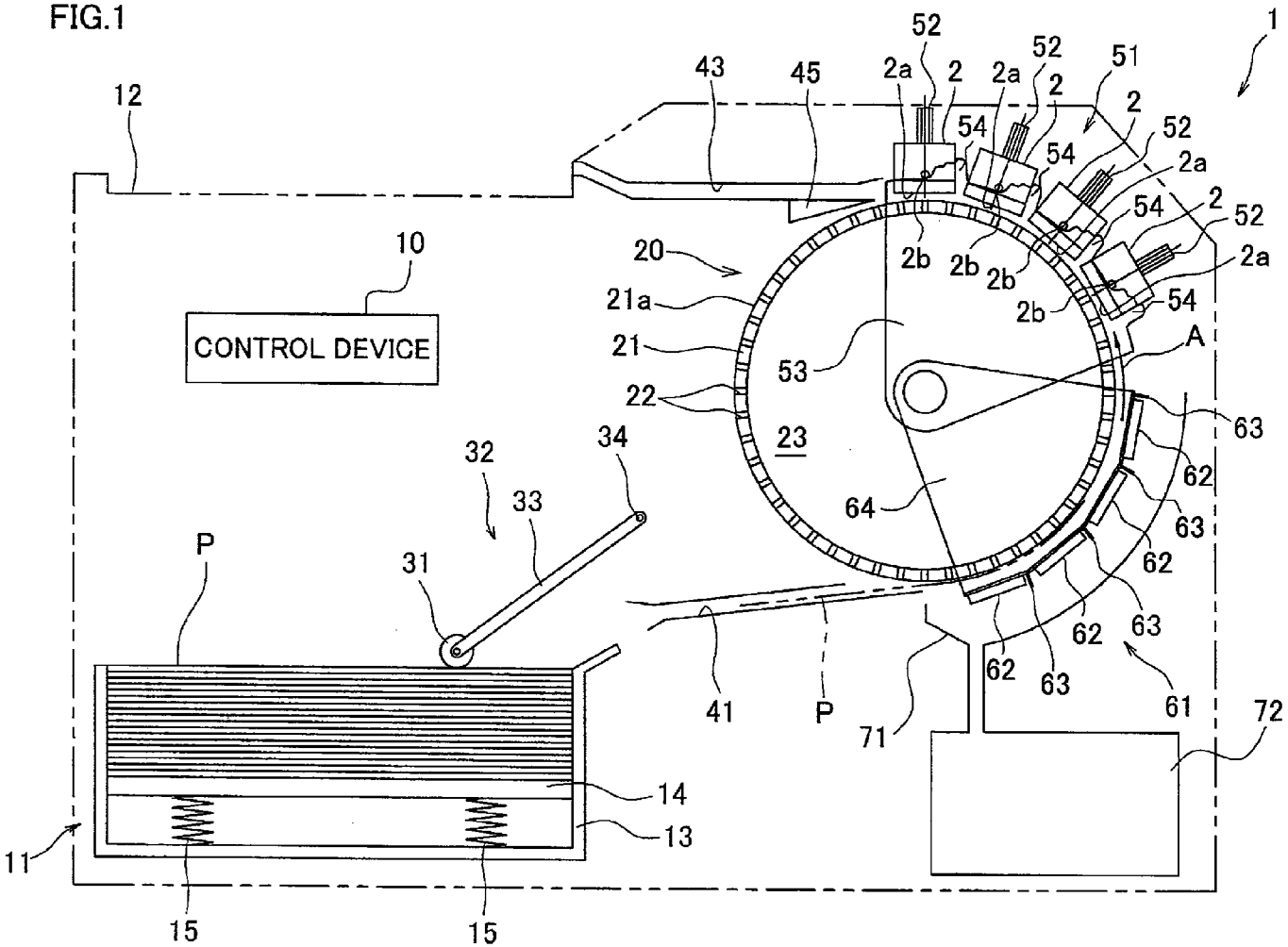
FIG. 1 is a side view illustrating an embodiment of an inkjet printer according to the present invention.

The following describes, with reference to FIG. 1, an embodiment of inkjet printer according to the present invention. An inkjet printer 1 which is an inkjet recording apparatus is a color inkjet printer, and includes: a sheet conveyance mechanism 20, four inkjet heads 2, a head-moving mechanism 51, a maintenance unit 61; a maintenance unit moving mechanism, and a control device 10. The sheet conveyance mechanism 20 includes a drum 21 having a cylindrical outer circumferential surface 21*a*. The maintenance unit moving mechanism includes a wiper-moving mechanism. The control device 10 serves as a control means which controls operations of the above mentioned members. In the lower part of the inkjet printer 1 is provided a sheet-feeding tray 11. On the top surface of the casing is provided a sheet receiving tray 12. Further, in the inkjet printer 1, a sheet conveyance path is formed. This sheet conveyance path extends from the sheet-feeding tray 11 to the lower end of the drum 21, and from the lower end of the drum 21 to the sheet receiving tray 12 via the upper end of the drum 21 along the outer circumferential surface 21 of the drum 21.

Each of the inkjet heads 2 has ink passages having nozzles for ejecting ink droplets, and is formed in a parallelepiped shape elongated in the axial direction of the drum 21. From each of these inkjet heads 2 is ejected ink of one of the following four colors: magenta, yellow, cyan, and black. These four inkjet heads 2 are aligned in the circumferential direction of the drum 21 along the outer circumferential surface thereof. In short, the inkjet printer 1 is a line printer.

The lower surface of each of the inkjet head 2 serves as an ejection surface 2*a* having thereon nozzle openings. This ejection surface 2*a* of the inkjet head 2 faces the outer circumferential surface 21*a*. Each of the four inkjet heads 2 is disposed so that the normal to the center of the ejection surface 2*a* is perpendicular to the outer circumferential surface 21*a*.

The sheet-feeding tray 11 has a tray main body 13 opened in the upper direction. In the tray main body 13 is stored a stack of sheets P. Inside the tray main body 13 are arranged a plate 14 which supports the sheets P from the bottom, and two springs 15 which urges the plate 14 upward. The plate 14 is formed in a plane shape which is substantially the same as the tray main body 13, and is disposed in such a manner that the plate 14 is able to move upward or downward within the tray main body 13.

Further, the inkjet printer 1 includes a pickup roller 31 and a pickup roller moving mechanism 32 which rotates the pickup roller 31. The pickup roller 31, while being rotated, contacts a sheet P at the top of the stack of sheets P so as to feed out the sheet P to the drum 21.

The pickup roller moving mechanism 32 includes a turning arm 33, a shaft 34, and a not-illustrated drive motor. A lower end of the turning arm 33 rotatably supports the pickup roller 31, and an upper end of the same is fixed to the shaft 34. The drive motor rotates the shaft 34 to rotate the turning arm 33 about the shaft 34. With this pickup roller moving mechanism 32, the turning arm 33 is moved so that the pickup roller 31 is positioned in one of the following two positions: a contact position where the pickup roller 31 contacts the uppermost sheet P in the tray main body 13; and a separation position where the pickup roller 31 is apart from the uppermost sheet P in the tray main body 13. While the pickup roller 31 is in the separation position, the sheet-feeding tray 11 is easily attached or detached. Note that aforementioned springs 15 are structured in such a manner that a friction within a predetermined range is generated between the pickup roller 31 and the uppermost sheet P, irrespective of the number of sheets P stored in the tray main body 13. This prevents a problem in feeding out a sheet P by the pickup roller 31.

Further, as a part of a sheet conveyance path, the inkjet printer 1 includes an introduction path 41 through which a sheet P sent out from the sheet-feeding tray 11 by the pickup roller 31 is lead to the outer circumferential surface 21*a* of the drum 21, which surface adsorbs and retains thereon the sheet P. The introduction path 41 is a substantially straight path which extends from the sheet-feeding tray 11 to the lower end of the drum 21.

The drum 21 has a pipe-like shape and the axial direction thereof conforms with a direction perpendicular to the surface of the FIG. 1. The both ends of the drum 21 is closed. These closed ends support the drum 21 so as to enable rotation of the drum 21 in the counter clockwise direction on the FIG. 1. This rotation of the drum 21 in the counter clockwise direction is done by means of a not-illustrated drive mechanism including a conveyance motor. The rotation of the drum 21 conveys a sheet adsorbed and retained on the outer circumferential surface 21*a* along the outer circumferential surface 21*a* of the drum 21, in a conveyance direction A indicated by the arrow; that is, in the circumferential direction of the drum 21.

The outer circumferential surface 21*a* is formed on a circumferential wall of the drum 21. This circumferential wall has through holes 22 communicating an internal space 23 of the drum 21 with the outside of the drum. These through holes 22 are all uniformly formed. The drum 21 is connected to a not-illustrated air-suction device which aspirates the air into the internal space 23. Driving of this air-suction device aspirates the external air into the internal space 23 via the through holes 22, thus enabling adsorption of a sheet P on the outer circumferential surface 21*a* of the drum 21.

As is understood from the above, the sheet conveyance mechanism 20 includes the drum 21, the drive mechanism, and the air-suction device. Driving the air-suction device adsorbs and retains on the outer circumferential surface 21*a* a sheet P having conveyed through the introduction path 41 from the sheet-feeding tray 11. Further, driving of the drive mechanism rotates the drum 21 in the counter clockwise direction, thereby conveying the sheet P in the conveyance direction A. Then, the inkjet heads 2 ejects ink of different colors to the sheet P conveyed on the drum 21, while the respective ejection surfaces 2*a* of the inkjet heads 2 face the sheet P. Thus, an intended colored image is printed on the sheet P.

Towards the downstream of the drum 21 in the conveyance direction A is provided a separator 45. The separator 45 separates a sheet P from the outer circumferential surface 21*a* of the drum 21 retaining the sheet P so as to feed the sheet P to an output path 43 which is also a part of the sheet conveyance path.

The head-moving mechanism 51 has four guide rails 52 and a cam 53 formed substantially in a shape of sector. Each of the guide rails 52 supports one of the inkjet heads 2 so as to enable the supported inkjet head 2 to move in a direction normal to the ejection surface 2*a*. Each of the inkjet heads 2 is urged in a direction towards the outer circumferential surface 21*a* by the gravity or a not-illustrated urging member. The cam 53 is a plate in the shape of sector facing an end of the drum 21. The cam 53 is capable of swinging about the rotational axis of the drum 21, in such a manner that the arched surface of the cam 53 moves in the circumferential direction along the outer circumferential surface 21*a* of the drum 21.

The cam 53 is swung by a not-illustrated positioning motor controlled by the control device 10. Note that lines hidden by the cam 53 in FIG. 1 are solid lines, though these lines should be dotted-lines. On the arched surface of the cam 53 are formed four projections 54 each projecting in the radial direction of the cam 53. These four projections 54 are all formed in the same shape. On the other hand, each of the inkjet heads 2 has a boss 2*b* projecting in the length direction thereof, on a side surface of the inkjet head 2 perpendicular to the length direction of the inkjet head 2; that is, perpendicular to the axial direction of the drum 21. The projections 54 on the cam 53 are positioned so as to respectively face the bosses 2*b* of the inkjet heads 2. Each projection 54 abuts the boss 2*b* of the corresponding inkjet head 2 to apply a force against the urging force applied to the inkjet head 2, thereby moving the inkjet head 2 in the direction departing from the outer circumferential surface 21*a*. Thus, each inkjet head 2 moves along the guide rail 52 in a direction normal to the ejection surface 2*a*.

Figure 2:
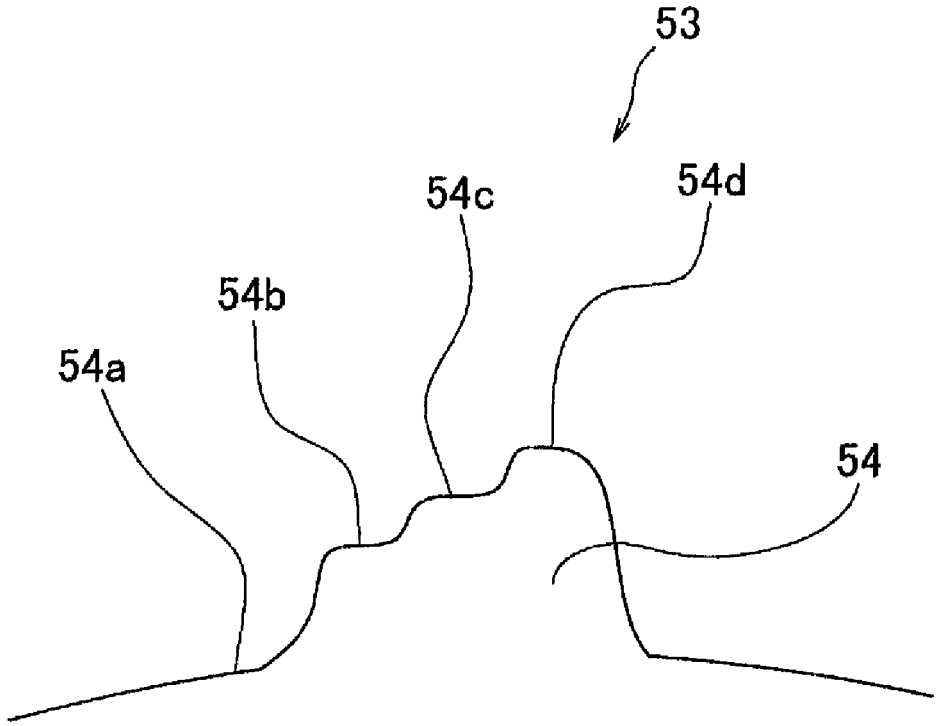
FIG. 2 is a partial enlarged view of a cam illustrated in FIG. 1.

The following details the projections 54 with reference to FIG. 2 and FIGS. 3A to 3D. FIG. 2 is a partial enlarged view of a cam 53. FIGS. 3A to 3D are diagrams each illustrating a positional relation between a projection 54 of the cam 53 and an inkjet head 2. As is understood from FIG. 1 and FIG. 2, the outer peripheral edge of each of the projections 54 is formed in a shape so that four abutting surfaces 54*a* to 54*d* are formed on the arched surface of the cam 53. The four abutting surfaces 54*a* to 54*d* are parallel to the ejection surface 2*a*, and are respectively apart from the rotational axis of the drum 21 by different distances. More specifically, the four abutting surfaces 54*a* to 54*d* are formed so that distance from the rotational axis increases from the middle left to the right of FIG. 2. Of these abutting surfaces 54*a* to 54*d*, one abutting surface and an adjacent abutting surface are made continuous by a curved surface. The abutting surface 54*a* is formed outside the projection 54 on the arched surface of the cam 53.

As illustrated in FIG. 3A to 3D, the control device 10 controls the angular orientation of the cam 53, so as to change which one of the abutting surfaces 54*a* to 54*d* abuts the boss 2*b* of the corresponding inkjet head 2. This varies the distance (hereinafter referred to as separation distance) from the boss 2*b* to the rotational axis of the drum 21; i.e., the distance from the outer circumferential surface 21*a* of the drum 21 to the ejection surface 2*a*. Of these four bosses 2*b*, two bosses 2*b* next to each other are distanced from each other in the circumferential directions by an amount equal to the distance in the circumferential direction between two adjacent projections 54 corresponding to the two bosses 2*b*. The bosses 2*b* of all the inkjet heads 2 therefore abut the same one of the abutting surfaces 54*a* to 54*d* of the corresponding projections 54. As such, the separation distances of all the inkjet heads 2 are the same. Thus, the four ejection surfaces 2*a* are aligned along the same circle with the rotational axis of the drum 21 as its center, no matter which one of the abutting surfaces 54*a* to 54*d* abuts the corresponding boss 2*b*.

Figures 3A, 3B, 3C, 3D:
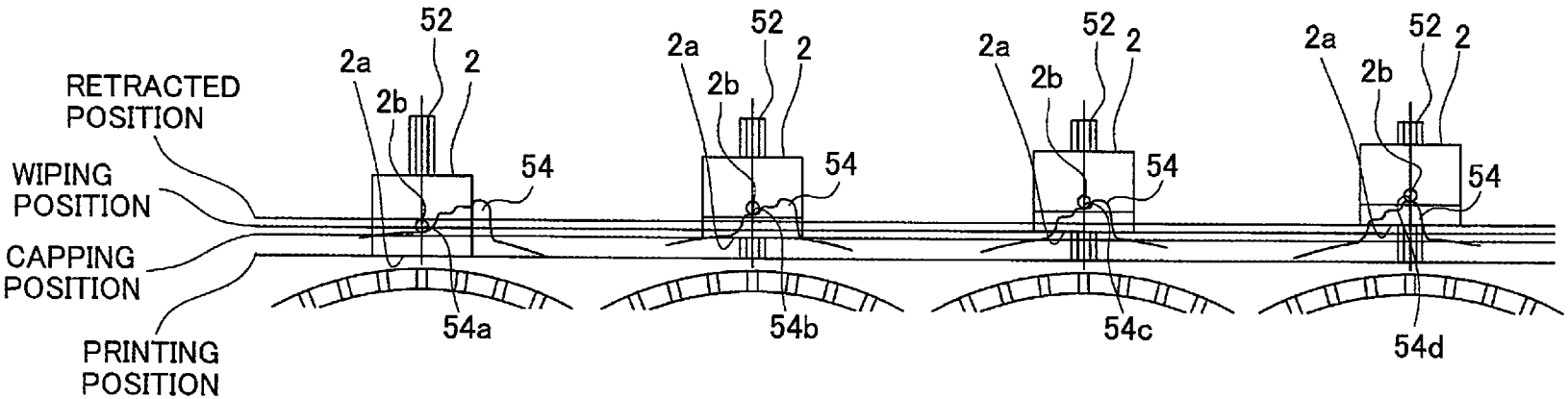
FIGS. 3A to 3D are diagrams each illustrating a positional relation between a projection of the cam and inkjet head.

As illustrated in FIG. 3A, when the abutting surface 54*a* abuts the corresponding boss 2*b*, the inkjet head 2 is in the printing position or recording position (see FIG. 1) for performing printing by ejecting ink droplets from the nozzles of the inkjet head 2 towards the sheet P.

As illustrated in FIG. 3B, when the abutting surface 54*b* abuts the corresponding boss 2*b*, the inkjet head 2 is in a capping position (See FIG. 7) in which each of later-mentioned caps 62 forms a sealed space having the ejection surface 2*a* as an inner-wall surface.

As illustrated in FIG. 3C, when the abutting surface 54*c* abuts the corresponding boss 2*b*, the inkjet head 2 is in the wiping position (See FIG. 8) in which the ejection surface 2*a* contacts a portion nearby a leading end of a later-mentioned wiper 63.

As illustrated in FIG. 3D, when the abutting surface 54*d* abuts the boss 2*b*, the inkjet head 2 is in a retracted position (See FIG. 5) in which the ejection surface 2*a* separates from the leading end of the wiper 63. The separation distances of the inkjet heads 2 in the above mentioned positions are such that: separation distance of the inkjet heads 2 in the printing position <separation distance of the same in the capping position <separation distance of the same in the wiping position <separation distance of the same in the retracted position.

Figure 4:
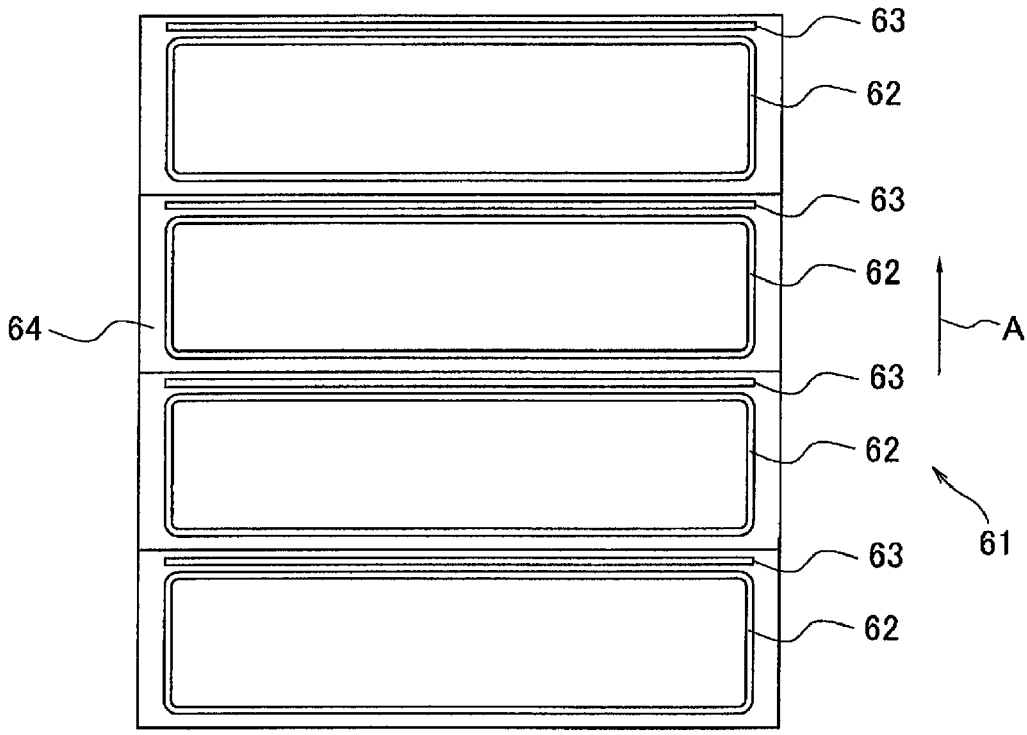
FIG. 4 is a development view of a maintenance unit of FIG. 1 developed on a plane.

The following describes the maintenance unit 61 with reference to FIG. 1 and FIG. 4. FIG. 4 is a development view illustrating a maintenance unit of FIG. 1 developed on a plane. As illustrated in FIG. 1 and FIG. 4, the maintenance unit 61 performs a maintenance of the ejection surfaces 2*a* of the inkjet heads 2, and includes: four caps 62 aligned in the conveyance direction A of the sheet P, four wipers 63 aligned in the conveyance direction A of the sheet P, a maintenance tray 64 supporting the caps 62 and wipers 63, a waste liquid tray 71, and a waste liquid tank 72.

Each of the caps 62 is made of an elastic material such as an ink-resistance rubber or resin. The each of the caps 62 has an annular projection having a substantially rectangular plane shape, which projection defines a recessed portion whose bottom surface is the maintenance tray 64. The recessed portion defined by the annular projection extends in the axial direction of the drum 21 in a plane view. The size of the recessed portion is smaller than the ejection surface 2*a*, but is sufficient for including the entire region of the ejection surface 2*a* where the nozzle openings are provided. While the caps 62 faces the ejection surfaces 2*a* and while the inkjet heads 2 are in the capping position, the annular projection of each of the caps 62 and the corresponding ejection surface 2*a* are closely attached, thereby forming a sealed space having the ejection surface 2*a* as an inner-wall surface. This restrains drying and thickening of the ink inside the nozzles. Further, through a purging operation for discharging thickened ink inside the nozzles, the ink ejected from the ejection surface 2*a* is received inside the cap 62 while avoiding dispersion of ink droplets outside the cap 62.

Each of the wipers 63 is a blade for wiping the ejection surface 2*a*, and is made of an elastic material such as an ink-resistant rubber or resin. The four wipers 63 all have the same size. Further, the wipers 63 is provided perpendicularly to the outer circumferential surface 21*a* of the drum 21, and extends in the axial direction of the drum 21. Each of the four wipers 63 is longer than the ejection surface 2*a* in the axial direction of the drum 21. The leading ends of the four wipers 63 may be positioned along a circle M along which the four ejection surfaces 2*a* of the inkjet heads 2 are aligned when the inkjet heads 2 are in the wiping position. Note, however, that the present embodiment deals with a case where the leading ends of the wipers 63 are positioned so as to slightly exceed from the circle M (See FIG. 8). An amount of each wiper exceeding from the circle M is designed so that the wiper 63 is capable of wiping the entire region of the ejection surface 2*a*.

The maintenance tray 64 is formed substantially in the shape of sector, and includes a curved part and a plane part connected to the curved part. The curved part faces the outer circumferential surface 21*a* of the drum 21, and is curved along the outer circumferential surface 21*a* of the drum 21. The plane part faces an end surface of the drum 21, and is capable of swinging about the rotational axis of the drum 21 so as to move the curved part in the circumferential direction of the outer circumferential surface 21*a* of the drum 21. The maintenance tray 64 is swung by a not-illustrated maintenance motor controlled by the control device 10. Note that lines hidden by the maintenance tray 64 in FIG. 1 are solid lines, though these lines should be dotted-lines. The outer surface of the curved part of the maintenance tray 64 holds the four wipers 63 and the four caps 62, in such a manner that the wipers 63 and the caps 62 are alternately positioned on the surface in the conveyance direction A of the sheet P. One of the wipers 63 is paired with an adjacent one of the caps 62, and a single pair of the wiper 63 and cap 62 corresponds to a single inkjet head 2. Further, in each pair, the wiper 63 is positioned upstream of the cap 62 in the conveyance direction A.

The control device 10 controls the angular orientation of the maintenance tray 64 to move the wipers 63 and caps 62 between the standby position and the opposing position (preparation position) along the outer circumferential surface 21*a* of the drum 21. The standby position is a position which is upstream from the four inkjet heads 2 in the conveyance direction A, and is a position where the maintenance tray 64 faces none of the ejection surfaces 2*a*. In other words, the standby position is a position where the maintenance tray 64 does not face an area including the four ejection surfaces 2*a*. The opposing position is a position where the maintenance tray 64 faces all the ejection surfaces 2*a*. While the wipers 63 and caps 62 are in the opposing position, each of the caps 62 faces the corresponding ejection surface 2*a* of the corresponding inkjet head 2. Further, while the wipers 63 and the caps 62 are in the standby position, the openings of the recessed portions of all the caps 62 are faced downward. Thus, waste ink stored in the caps 62 from the caps 62 due to its own weight. In the present embodiment, the maintenance tray 64 and the maintenance motor or the like, form a maintenance unit moving mechanism including the wiper-moving mechanism.

The waste liquid tray 71 is positioned so as to be located below the caps 62 while the caps 62 are in the standby position. This waste liquid tray 71 leads, to the waste liquid tank 72, the waste ink discharged from the caps 62 in the standby position. The waste liquid tank 72 is positioned below the waste liquid tray 71, and stores therein the waste ink having lead by the waste liquid tray 71.

Next, the following describes an operation which takes place at a time of performing printing to the sheet P. It is supposed that the inkjet heads 2 are brought to the printing position prior to the printing. First, a sheet P is fed to the drum 21 from the sheet-feeding tray 11. In this step, the uppermost sheet P among a stack of sheets P stored in the sheet-feeding tray 11 contacts the pickup roller 31. The pickup roller 31 rotates counter clockwise while being in contact with the sheet P, thereby feeding the sheet P to the introduction path 41. The sheet P fed out is then lead through the introduction path 41, and arrives at the drum 21.

At the same time, the drive mechanism drives the drum 21 to rotate the drum 21 in the conveyance direction A, and the air-suction device is driven to adsorb and retain the sheet P on the outer circumferential surface 21*a* of the drum 21. The sheet P retained on the outer circumferential surface 21*a* of the drum 21 is then conveyed in the conveyance direction A with the rotation of the drum 21.

When the sheet P reaches a position so as to face the ejection surface 2*a*, the ejection surfaces 2*a* of the four inkjet heads 2 eject ink from their nozzles to form an image on the sheet P. Then, the sheet P on which the image is formed is separated from the outer circumferential surface 21*a* of the drum 21 by the separator 45, and is fed out to the output path 43. The sheet P fed to the output path 43 is conveyed towards the sheet receiving tray 12, and is received by the sheet receiving tray 12.

Next, the following details with reference to FIG. 5 to FIG. 9 a maintenance operation of the inkjet heads 2. The maintenance operation of the inkjet heads 2 includes: a process of discharging thickened ink inside the nozzle openings on the ejection surfaces 2*a*, and a process of shaping meniscus of ink formed on each of the nozzle openings. The maintenance operation is performed at a time of powering on the inkjet printer 1, or immediately before the printing to a sheet P.

Figure 5:
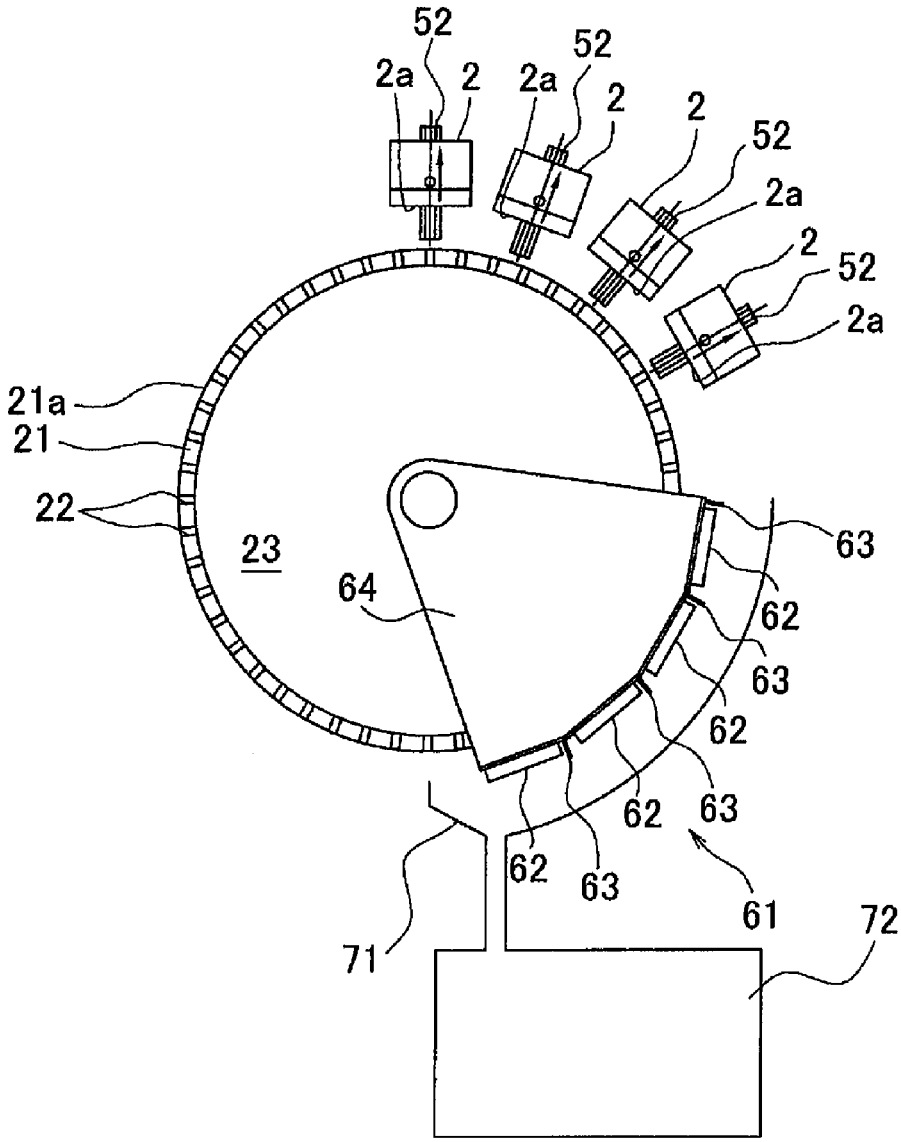
FIG. 5 to FIG. 9 are side views each illustrating a positional relation between an inkjet head and the maintenance unit, during each step of the maintenance operation taking place in the inkjet head illustrated in FIG. 1.

FIG. 1 illustrates an ordinary state where printing to the sheet P is possible. During this state, each of the inkjet heads 2 is in the printing position, and the boss 2*b* of the inkjet head 2 abuts the abutting surface 54*a* of the corresponding one of projections 54. Further, the wipers 63 and caps 62 are in standby position. When the maintenance operation starts during this state, the control device 10 controls the angular orientation of the cam 53 so that the boss 2*b* of each of the inkjet heads 2 abuts the abutting surface 54*d*. Thus, the inkjet heads 2 move from the printing position to the retracted position, as illustrated in FIG. 5.

Figure 6:
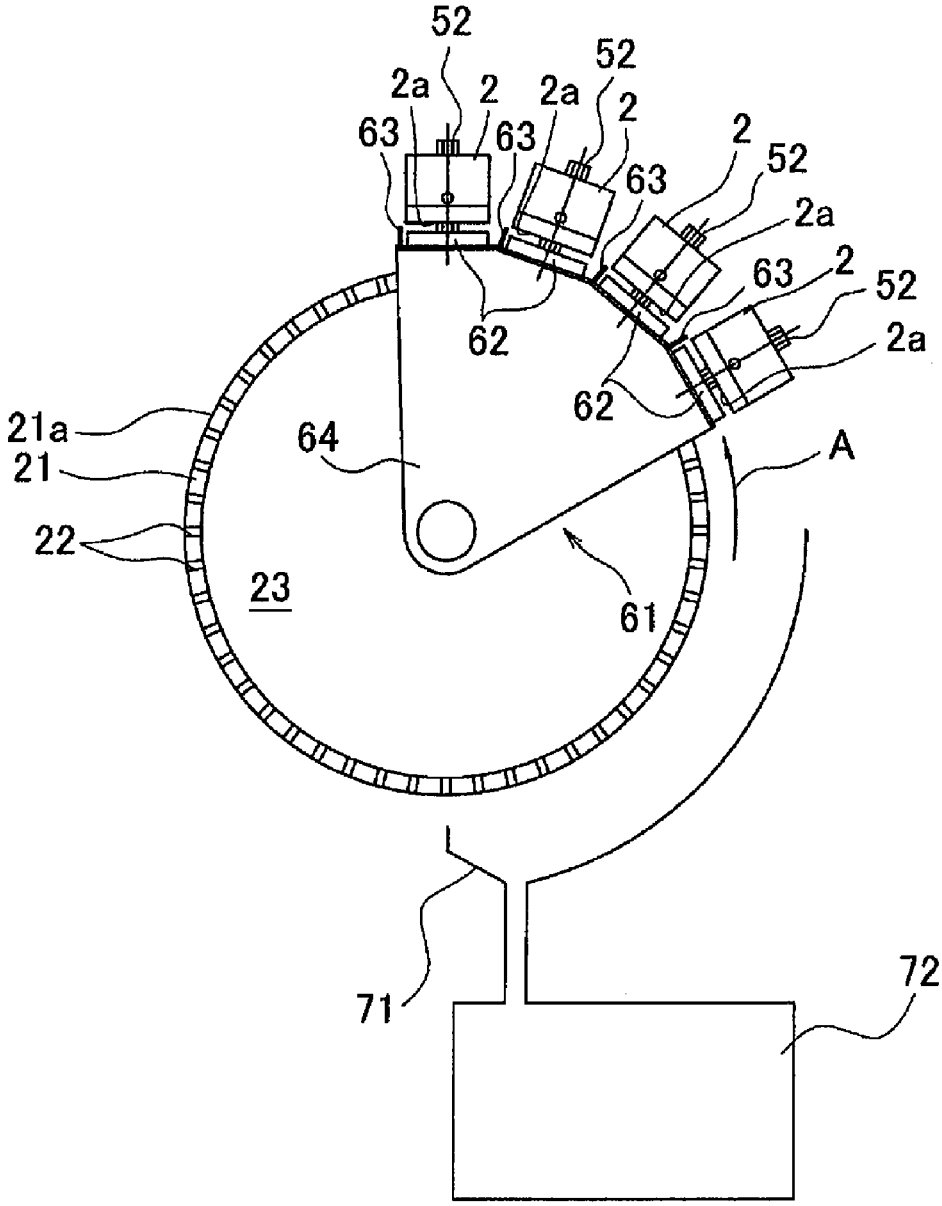

Then, the control device 10 controls the angular orientation of the maintenance tray 64 to move the wipers 63 and caps 62 from the standby position to the opposing position, as illustrated in FIG. 6. Thus, each of the caps 62 faces corresponding one of the ejection surfaces 2*a*. Each of the wipers 63 on the other hand is positioned slightly downstream from the corresponding one of the ejection surfaces 2*a* in the conveyance direction A. In other words, each of the wipers 53 moves from the standby position to the opposite side of the corresponding one of the ejection surfaces 2*a*.

Figure 7:
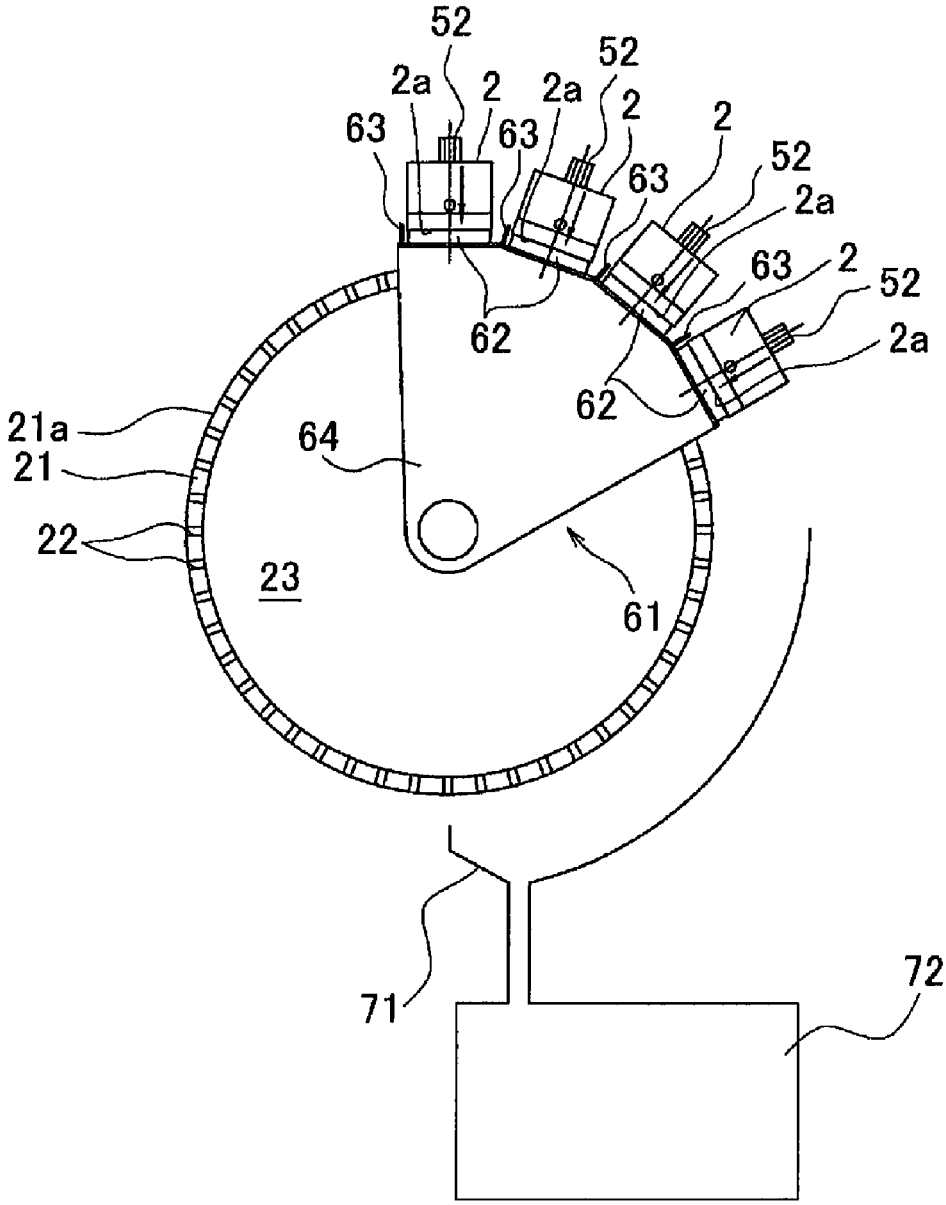

Further, the control device 10 controls the angular orientation of the cam 53 so that the boss 2*b* of each of the inkjet heads 2 abuts the abutting surface 54*b*. This moves the inkjet head 2 from the retracted position to the capping position, as illustrated in FIG. 7. As a result, the ejection surface 2*a* and the annular projection of the cap 62 are closely attached to each other, forming a sealed space having the ejection surface 2*a* as an inner-wall surfaces. Further, a purging operation for discharging the thickened ink in the nozzles and the air inside the inkjet head 2 is performed under the control of the control device 10. The purging operation is performed by driving a not-illustrated pomp connected to the ink supply path of the inkjet head 2. At this point the ink ejected from the ejection surface 2*a* is received in the cap 62.

Figure 8:
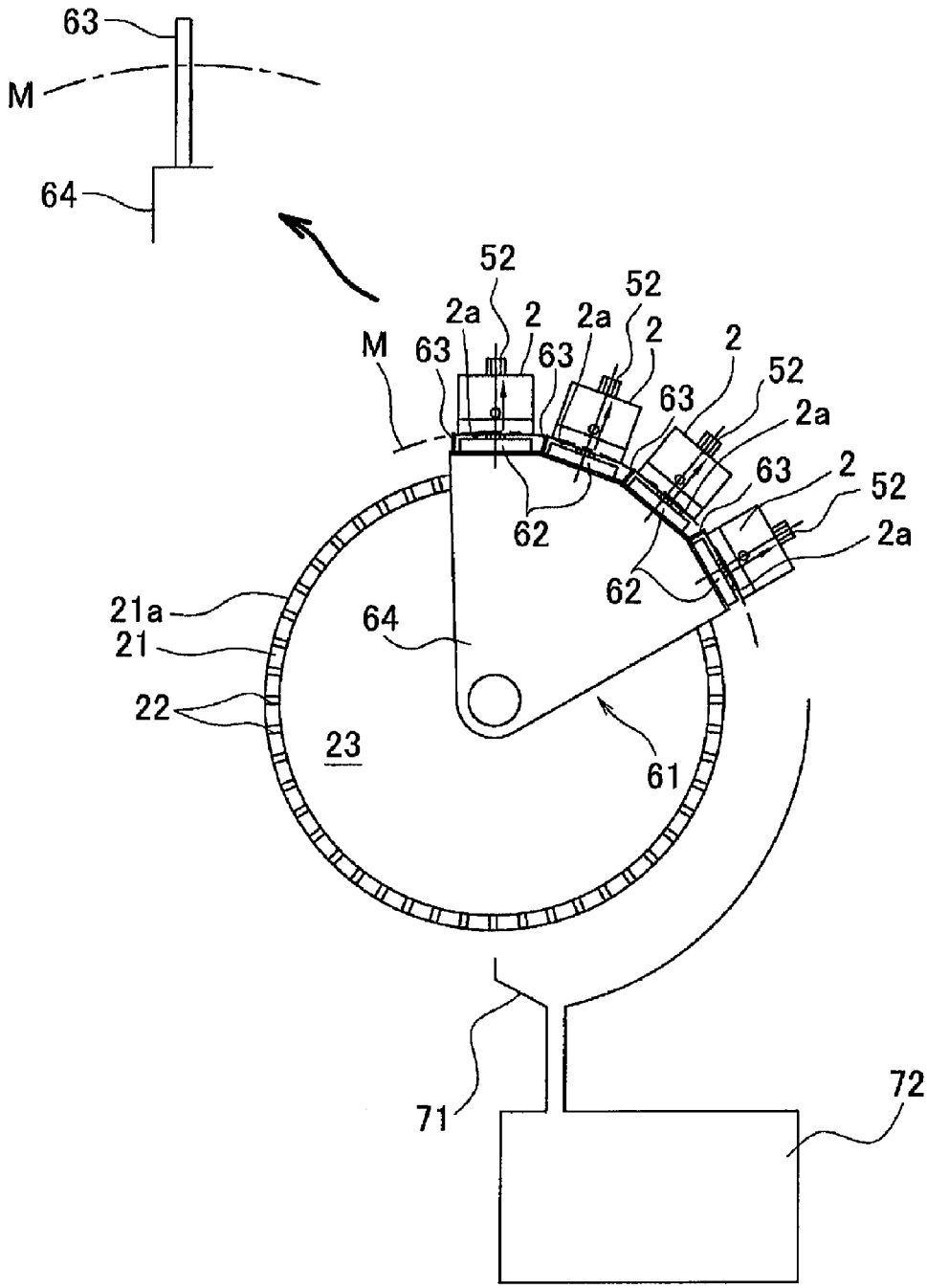

When the purging operation is completed, the control device 10 controls the angular orientation of the cam 53 so that the boss 2*b* of each of the inkjet heads 2 abuts the abutting surface 54*c*. Thus, the inkjet head 2 moves from the capping position to the wiping position as illustrated in FIG. 8.

Figure 9:
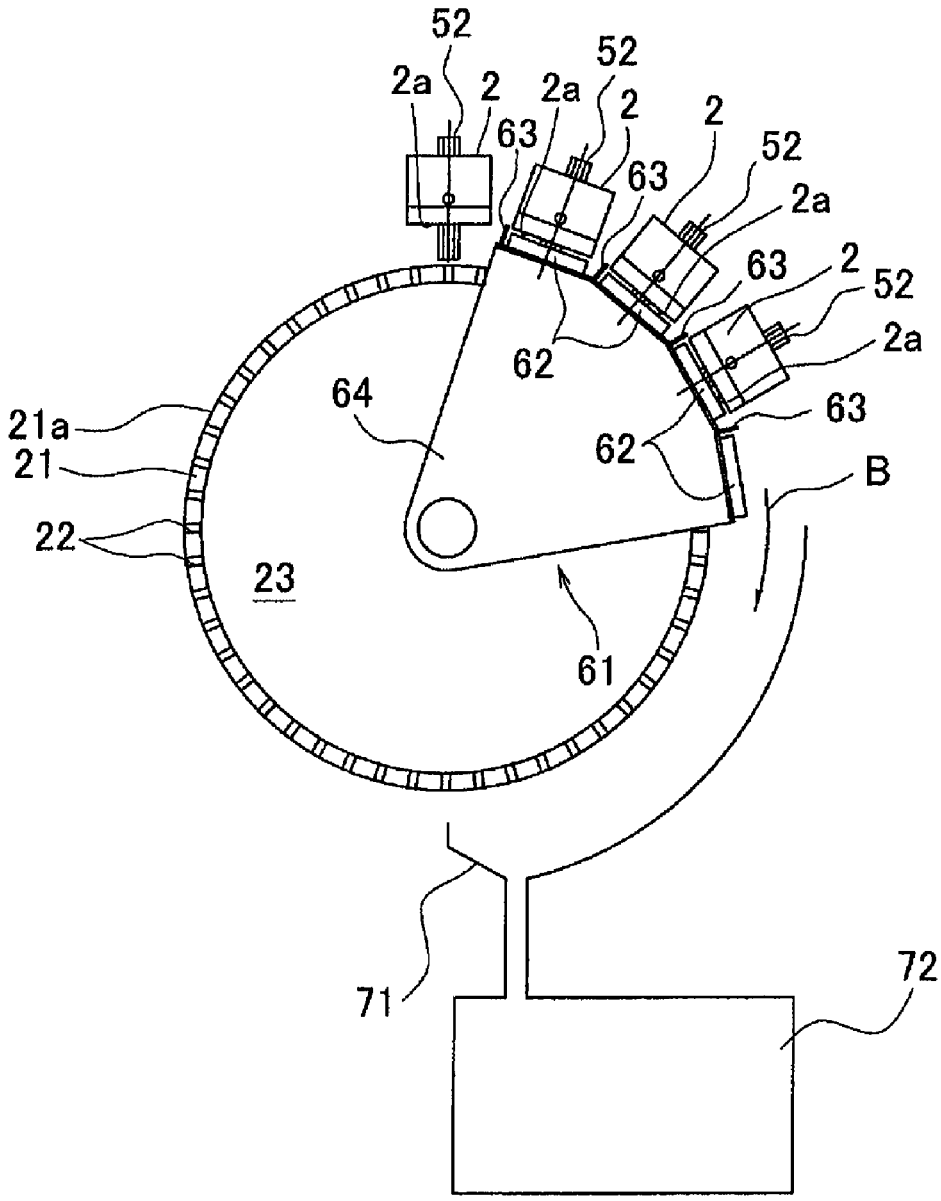

Then, as illustrated in FIG. 9, the control device 10 controls the angular orientation of the maintenance tray 64 to move the wiper 63 and the cap 62 in a direction from the opposing position to the standby position so that each wiper 63 passes only one of the ejection surfaces 2*a* corresponding to the wiper 63. In other words, the control device 10 controls the angular orientation of the maintenance tray 64 to move the wiper 63 and the cap 62 in a reverse conveyance direction B indicated by the arrow so that each wiper 63 moves from the opposing position to the opposite side of the corresponding one of the ejection surfaces 2*a*. During this state, the leading ends of the four wipers 63 are positioned so as to slightly exceeds the circle M along which the ejection surfaces 2*a* of the four heads 2 in the wiping position are aligned. Thus, each of the wipers 63 moves in the reverse conveyance direction B, while being in contact with the corresponding one of the ejection surfaces 2*a*. This allows the wipers 63 to wipe the entire ejection surfaces 2*a*, respectively. Thus, shaping of meniscus to be formed at each of the nozzle openings is possible.

Then, the control device 10 controls the angular orientation of the cam 53 so that the boss 2*b* of each of the inkjet heads 2 abuts the abutting surface 54*d*. This moves the inkjet heads 2 from the wiping position to the retracted position. The control device 10 further controls the angular orientation of the maintenance tray 64 so that the wipers 63 and caps 62 move to the standby position in the reverse conveyance direction B. Then, waste ink in the caps 62 in the standby position is discharged therefrom to the waste liquid tray 71. The discharged waste ink is then lead to the waste liquid tank 72 through the waste liquid tray 71.

Then, the control device 10 controls the angular orientation of the cam 53 so that the boss 2*b* of each of the inkjet heads 2 abuts the abutting surface 54*a*. This moves the inkjet heads 2 from the retracted position to the printing position as illustrated in FIG. 1, and the maintenance operation of the inkjet heads 2 is completed.

According to the above detailed embodiment, the wiper 63 wipes corresponding one of the ejection surfaces 2*a* while moving in the circumferential direction along the outer circumferential surface 21*a* of the drum 21. Therefore, wiping of the ejection surface 2*a* is possible with a simple structure in which the wipers 63 are not moved in the axial direction of the drum 21.

For each of the inkjet heads 2 in the printer 1 of the present embodiment, the normal of the ejection surface 2*a* is perpendicular to the outer circumferential surface 21*a*, and the separation distances of all the inkjet heads 2 are the same whether all the inkjet heads 2 are in the printing position or in the wiping position. Thus, unevenness in the contact strength of wipers 63 made of an elastic material to the ejection surfaces 2*a*, which occurs within the four ejection surfaces 2*a*, is made extremely insignificant. As a result, all four ejection surfaces 2*a* are evenly wiped entirely.

Further, the head-moving mechanism 51 is able to move the inkjet heads 2 by means of a simple structure adopting four guide rails 52 and a single cam 53. Adoption of such a structure in which the cam 53 swing about the rotational axis of the drum 21 allows a simple structure of the head-moving mechanism 51.

Further, the maintenance unit 61 has four wipers 63, the number of which corresponds to the number of the inkjet heads 2. The four wipers 63 are aligned in the circumferential direction along the outer circumferential surface of the drum 21. During the maintenance operation, the four wipers 63 respectively wipes corresponding ejection surfaces 2*a*. Therefore, contamination of ink on the ejection surface 2*a* is prevented.

In addition, the inkjet heads 2 are moveable to the retracted position by means of the head-moving mechanism, which enables the wipers 63 to move without contacting the ejection surfaces 2*a*. This restrains damage to meniscus formed on each nozzle opening.

Note that in the above embodiment, each of the inkjet heads 2 are positioned so that the normal of the ejection surface 2*a* is perpendicular to the outer circumferential surface 21*a*, and that the separation distances of all the inkjet heads 2 are the same whether all the inkjet heads 2 are in the printing position or in the wiping position. However, the normal of the ejection surface 2*a* of each head 2 does not necessarily have to be perpendicular to the outer circumferential surface 21*a*. Further, the separation distances of all four inkjet heads 2 do not have to be the same. Further, the head-moving mechanism 51 may move the four heads 2 in a direction slanted in relation to the normal of the ejection surfaces 2*a*.

The above embodiment deals with a case where the maintenance unit 61 includes four wipers 63, and the four wipers 63 wipe the corresponding ejection surfaces 2*a* during the maintenance operation, respectively. However, it is possible to adopt a maintenance unit 61 having a single wiper which wipes all four ejection surfaces 2*a*. Alternatively, it is also possible to adopt a maintenance unit 61 having two wipers each of which wipes two of the ejection surfaces 2*a*.

Further, in the above embodiment, the inkjet heads 2 are moved by swinging the cam 53 about the rotational axis of the drum 21. However, other structures are possible for moving the inkjet heads 2. For example, the inkjet heads may be moved independently from the others, by means of a linear actuator. Alternatively, a cam may be provided for each of the heads. Note that the four heads 21 do not necessarily have to move simultaneously.

Further, the above embodiment allows the inkjet heads 2 to be moved to the retracted position. However, a structure which does not move the inkjet heads 2 to the retracted position is also possible. In such a case, the inkjet heads 2 are moved to the wiping position, instead of the retracted position. Note, however, that the ejection surfaces 2*a* are wiped even when the wiping operation is not necessary.

Further, the above embodiment deals with a case where, during the maintenance operation, the wipers 63 moves from the standby position to the opposing position in the conveyance direction A, and then wipes the corresponding ejection surfaces 2*a* while moving back in the reverse conveyance direction B. However, the wipers 63 may wipe the corresponding ejection surfaces 2*a* while moving in the conveyance direction A.

Further, the above embodiment deals with a case where the caps 62 receives the ejected ink droplets. However, these caps may be omitted. Instead, a purge area capable of retaining ink to a predetermined position of the outer circumferential surface 21 of the drum 21 may be provided, and ink droplets may be ejected to the purge area during the purging operation. This allows omission of the process of forming with the cap 62 a sealed space having the ejection surface 2*a* as an inner-wall surface. As a result, the maintenance operation is promptly completed. In this case, the wiper 63 is moved only between the opposing position as illustrated in FIG. 8 and the position illustrated in FIG. 9; that is, a position on the opposite side of the ejection surface 2*a* across from the opposing position.

Further, in the above case, it is also possible to adopt a structure in which the wipers 63 wipes the corresponding ejection surfaces 2*a* when the wipers 63 moves in the conveyance direction A and in the reverse conveyance direction B. In the maintenance operation, the inkjet heads 2 may be moved to the wiping position after the purging operation performed with the inkjet heads 2 in the printing position, and then wipe the ejection surfaces 2*a* in the wiping position with the wipers 63. After the wiping is completed, the wipers 63 may be kept in the same position, and the inkjet heads 2 may be moved to the printing position to complete the maintenance operation. In this case, the wipers 63 are moved to the opposite direction to wipe the ejection surfaces 2*a* in the next wiping operation performed after the purging operation. This allows further promptness of the maintenance operation.

Further, the above embodiment deals with a case where a sheet P is held on the outer circumferential surface of the drum 21 by means of the air-suction device. However, the outer circumferential surface of the drum 21 may posses adhesiveness. This simplifies the structure of the device.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus, comprising:

a drum having a cylindrical outer circumferential surface, which rotates about a rotation axis thereof to convey a recording medium retained on the outer circumferential surface;

a wiper extended in an axial direction of the drum;

a plurality of inkjet heads aligned in the circumferential direction of the drum along the outer circumferential surface of the drum, wherein each of the inkjet heads has an ejection surface on which a plurality of nozzles for ejecting ink droplets are opened, the ejection surface being extended in the axial direction and facing the outer circumferential surface;

a head-moving mechanism which moves the inkjet heads to any one of positions including a recording position and a wiping position, wherein the recording position is a position where inkjet heads are disposed at a time of forming an image on a recording medium on the outer circumferential surface by ejecting ink droplets from the nozzles to the recording medium, and the wiping position is such a position that the ejection surface of each of the inkjet heads is farther distanced from the outer circumferential surface than in the recording position;

a wiper-moving mechanism which moves the wiper in the circumferential direction along the outer circumferential surface so as to wipe the ejection surface of at least one of the inkjet heads in the wiping position; and a control unit which controls the wiper-moving mechanism so that the ejection surface of the at least one of the inkjet heads is wiped by the wiper moving in the circumferential direction while the inkjet heads are in the wiping position.

2. The apparatus according to claim 1, wherein the inkjet heads are disposed so that a normal direction of the ejection surface of each of the inkjet heads is perpendicular to the outer circumferential surface, and that ejection surfaces of all the inkjet heads are apart from the outer circumferential surface by the same distance whether all the inkjet heads are in the recording position or in the wiping position.

3. The apparatus according to claim 2, wherein:

the head-moving mechanism includes guide rails supporting the inkjet heads so as to enable each of the inkjet heads to move in a direction normal to the ejection surface thereof, and a cam which moves the inkjet heads by contacting the inkjet heads.

4. The apparatus according to claim 3, wherein the cam moves the inkjet heads by swinging about the rotational axis of the drum.

5. The apparatus according to claim 1, wherein:

the number of wipers and that of the inkjet heads are the same, and a plurality of the wipers are aligned in the circumferential direction along the outer circumferential surface;

the wiper-moving mechanism moves the plurality of the wipers; and the control unit controls the wiper-moving mechanism so that the plurality of the wipers respectively wipe the inkjet heads while the inkjet heads are in the wiping position.

6. The apparatus according to claim 1, wherein the head-moving mechanism is capable of moving the inkjet heads to a retracted position so that the ejection surface of each of the inkjet heads in the retracted position is farther distanced from the outer circumferential surface than in the wiping position, and that, when the wiper moved by the wiper-moving mechanism is in a position to face the ejection surface of any one of the inkjet heads, the wiper is apart from the inkjet head.

7. The apparatus according to claim 1, wherein the wiper-moving mechanism is configured to move the wiper between a standby position and a preparation position in the circumferential direction along the outer circumferential surface, wherein the standby position is a position at which the wiper is outside of an area including the ejection surface and the preparation position is a position at which the wiper faces the ejection surface of at least one of the inkjet heads in the standby position; and the wiper is configured to wipe the ejection surface of the at least one of the inkjet heads in the wiping position when the wiper moves between the standby position and the preparation position.

8. The apparatus according to claim 1, wherein the wiper has a length greater than a length of the ejection surface in the axial direction.

9. An inkjet recording apparatus, comprising:

a drum having a cylindrical outer circumferential surface, which rotates about a rotation axis thereof to convey a recording medium retained on the outer circumferential surface;

a maintenance unit comprising a wiper and a cap both extending in an axial direction of the drum;

a plurality of inkjet heads aligned in the circumferential direction of the drum along the outer circumferential surface of the drum, wherein each of the inkjet heads has an ejection surface on which a plurality of nozzles for ejecting ink droplets are opened, the ejection surface being extended in the axial direction and facing the outer circumferential surface;

a head-moving mechanism which moves the inkjet heads to any one of positions including a recording position, a wiping position, and a capping position, wherein the recording position is a position where inkjet heads are disposed at a time of forming an image on a recording medium on the outer circumferential surface by ejecting ink droplets from the nozzles to the recording medium, and the wiping position is such a position that the ejection surface of each of the inkjet heads is farther distanced from the outer circumferential surface than in the recording position, and the capping position is a position at which the ejection surface of each of the inkjet heads is closer to the outer circumferential surface than the wiping position and is farther from the outer circumferential surface than the recording position;

a maintenance unit moving mechanism which moves the wiper and the cap in the circumferential direction along the outer circumferential surface so as to wipe the ejection surface of at least one of the inkjet heads in the wiping position; and control means for controlling the maintenance unit moving mechanism so that the ejection surface of the at least one of the inkjet heads is wiped while the inkjet heads are in the wiping position, wherein, after the plurality of inkjet heads move from the capping position, at which the cap forms a sealed space having the ejection surface as an inner-wall surface, to the wiping position, the wiper moves to pass only one of the ejection surfaces such that the ejection surface is wiped by the wiper.

* * * * *